US005235839A

United States Patent [19]

Lee, Jr. et al.

[11] Patent Number: 5,235,839

[45] Date of Patent: Aug. 17, 1993

[54] APPARATUS FOR FLANGING CONTAINERS

[75] Inventors: Harry W. Lee, Jr., Chesterfield County; Eric L. Jensen, Richmond, both of Va.

[73] Assignee: Reynolds Metals Company, Richmond, Va.

[21] Appl. No.: 921,166

[22] Filed: Jul. 29, 1992

[51] Int. Cl.[5] ..... B21D 19/04

[52] U.S. Cl. ..... 72/117; 72/126

[58] Field of Search ..... 72/117, 118, 126, 379.4

[56] References Cited

U.S. PATENT DOCUMENTS 2,298,366 10/1942 Gladfelter et al. .
3,494,162 2/1970 Hansson .
3,983,729 10/1976 Traczyk et al. .
4,058,998 11/1977 Franek et al. .
5,121,621 6/1992 Ihly ..... 72/126

FOREIGN PATENT DOCUMENTS 3739331 7/1988 Fed. Rep. of Germany ..... 72/117

*Primary Examiner*—Lowell A. Larson
*Attorney, Agent, or Firm*—Robert C. Lyne, Jr.

[57] ABSTRACT

A flanging head assembly having a cluster of freely rotatable spin flanging rollers includes a stop ring against which the flange hits during the final flange forming stages to limit the flange to a specific diameter. To prevent the flange from entering the crack formed between the rotating roller and the stationary stop ring, there is provided a step spacing the stop ring surface from the roller forming surface. In this manner, as the terminal edge of the flange slides around the flanging roller during final forming, it will pass over the crack and across the step to lodge in a corner formed between the step and stop ring surface. In a preferred embodiment, the step is a conical surface extending from the stop ring surface in a direction away from the can bottom. This conical surface extends radially inwardly a sufficient distance to contact unsupported flange portions between the flanging rollers to limit the degree of elastic sagging of these portions.

14 Claims, 5 Drawing Sheets

APPARATUS FOR FLANGING CONTAINERS

TECHNICAL FIELD

The present invention relates generally to mechanisms for flanging an open end of a metal can or other container and, more particularly, to a spinning flanging head co-acting with a stationary stop ring to control and flange the open end.

BACKGROUND OF THE INVENTION

Metal cans or containers, such as aluminum cans to contain beverages, are commonly manufactured by drawing and ironing a circular metal blank into a cylindrical can body having a side wall and a bottom wall. Such cans are then fed into necking and flanging apparatus by transfer or star wheels. Each can enters one of a number of stations in a necking turret undergoing rotational movement which is synchronous with the continued movement of the cans in the star wheel. During this rotational movement, the peripheral edge portion of the can side wall is formed by annular die members or spin forming members to form a neck of reduced diameter at the open end of the can. The necked cans are then transferred via transfer wheels to a flanging turret where the open edge of the can is flanged into a radially outward directed flange suitable for later receiving a can end in a known manner. The arrangement of drawing and ironing machines for forming the can bodies, and machines containing necking and flanging turrets are well known in the art.

A plurality of flanging heads are typically circumferentially spaced at the periphery of the flanging turret. Each flanging head has plural flanging rollers or spinners freely rotatably supported about their respective longitudinal axes in a central housing or cage. The cage is rotatable about its central longitudinal axis so that the flanging rollers revolve therearound in planetary relationship during flanging. Each flanging head typically includes an outer housing formed with a mounting flange adapted to be bolted to a mounting disk attached to the flanging turret, as is well known. The central housing containing the flanging rollers is rotatably disposed in the outer housing with ball bearings. A splined shaft projecting rearwardly from the outer housing is attached to the central housing to impart rotational movement about the central longitudinal axis via meshing contact with gearing disposed within the flanging turret.

The front of the flanging head is defined by a stop ring 100 (depicted in prior art FIG. 3) bolted to the outer housing. A retainer plate sandwiched between the stop ring and ball bearing elements assists in maintaining the forming surface 120 of each flanging roller 140 in operative alignment with the stop surfaces 160 on the stop ring 100. As the flanging heads rotate, the marginal necked portion 180 of the can is advanced into contact with the rotating cluster of flanging rollers 140. Since the can does not rotate, contact between the marginal end 180 with the revolving rollers 140 induces free rotation of each roller which results in spinning contact and flange formation as the open end of the can contacts the progressively larger diameter portions 200 of each roller. These progressively larger diameter portions 200 cause corresponding enlargement of the can end and deflection of the metal into a flange 220 extending approximately perpendicular to the longitudinal axis of the can.

As the formed flange 220 is in its final forming stages during final camming movement of the can against the rotating rollers 140, the flange end contacts the stop surfaces 160 of the stationary stop ring 100, whose purpose is to stop the flange 220 at a specific preselected diameter so that the flange has the same width along all sides of the can. In practice, however, the annular flange 220 usually strikes one side of the surface 160 before it hits all sides. When this happens, it usually takes only a small additional force to disadvantageously force the flange into the crack 240 formed between the rotating roller 140 and the stationary stop ring 100. When this occurs, the can is ruined and must be scrapped, since the metal forced into the crack 240 forms a sharp vertical ear on the can flange 220.

DISCLOSURE OF THE INVENTION

It is one object of the present invention to prevent tearing of a can flange during flange formation.

Another object of the invention is to prevent undesirable formation of sharp vertical ears in a can flange, during flange forming, with only slight modification to existing flanging head assemblies.

Yet a further object is to prevent tearing of a can flange by preventing the flange from entering the crack formed between the rotating spinner and the stationary stop ring found in flanging head assemblies.

The present invention is directed to improvements in flanging head assemblies for producing a peripheral flange on a free edge portion of a can or other container having a cylindrical body. The flanging head assembly is adapted to be mounted at the periphery of a flanging turret, and the cans to be flanged are typically conveyed by a star wheel along a path of movement which is parallel to and spaced from the path of movement of the flanging head assembly. A camming mechanism directs the open end of the can into contact with the flanging head assembly, where the open end engages a cluster of flanging rollers producing a peripheral outwardly directed flange in the open end. Each flanging roller has profiled flange forming surfaces adapted to receive the free edge portion of the can and spin same in a radially outward direction during axial movement of the free edge portion toward and against progressively larger diameter portions of the forming surfaces. The flanging rollers are mounted within a housing in circumferentially spaced relationship about a central longitudinal axis thereof. The rollers are revolved about the central longitudinal axis to create spinning contact with the axially advancing free edge portion. A stop ring has a stop surface mounted adjacent the forming surfaces to contact the free edge of the flange as it moves off the forming surfaces, thereby limiting further advancing and defining the final diameter of the flange. In accordance with this invention, the improvement comprises a step formed in the stop ring which spaces the stop surface from the forming surfaces. The step enables the terminal end of the flange being formed to travel past an interface gap or crack between the flanging roller and stop ring and across the step to contact the stop surface and avoid becoming entrapped in the gap.

The portion of the flange in between the flanging rollers or spinners is unsupported and tends to relax elastically which allows the outside edge of the flange to move radially toward the center of the can and slide off the step. The tip of the flange now tends to sag forwardly toward the open end of the can. In accordance with a preferred embodiment of this invention, the step is formed as an annular surface extending radially inwardly from the stop surface towards the can longitudinal axis. In this manner, the step controls the elastic movement of the unsupported flange between the spinners, by means of positive contact therewith. Thus, as the unsupported flange rotates relatively back toward the spinner, the spinner does not have to lift the flange as far to get it back into the corner formed at the intersection of the step with the stop surface, due to the fact that the step minimizes forward sagging of the unsupported flange between the spinners.

The feature of controlling forward sagging movement of the unsupported flange between adjacent spinners by radially inwardly extending the annular step a sufficient distance to positively contact, and limit or minimize elastically sagging movement of all unsupported flange portions, in combination with providing a sharp corner or intersection between the stop surface and the annular step, advantageously assures that the ultimate flange diameter is positively controlled by the capturing of the flange in the corners formed between the stop surface and annular step while the step minimizes forward sagging of the unsupported flange. Thus, as the unsupported flange rotates towards the forming surfaces of the spinners, it does not have to be lifted as far to get it back into the corner. In this manner, the unsupported sagging flange portions are also prevented from becoming entrapped in the gap.

The step and stop surface may be perpendicular to each other to form a sharp interior corner to capture and trap the flange thereagainst. Preferably, however, to prevent the spinner from being formed with a feather edge, i.e., a thin knife edge, the step is a conical surface extending at an angle of from about 10° to 40° relative to a plane passing through the corner perpendicular to the rotating axis of the spinner.

Still other objects and advantages of the present invention will become readily apparent to those skilled in this art from the following detailed description, wherein only the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

BEST MODE FOR CARRYING OUT THE INVENTION

Figure 1:
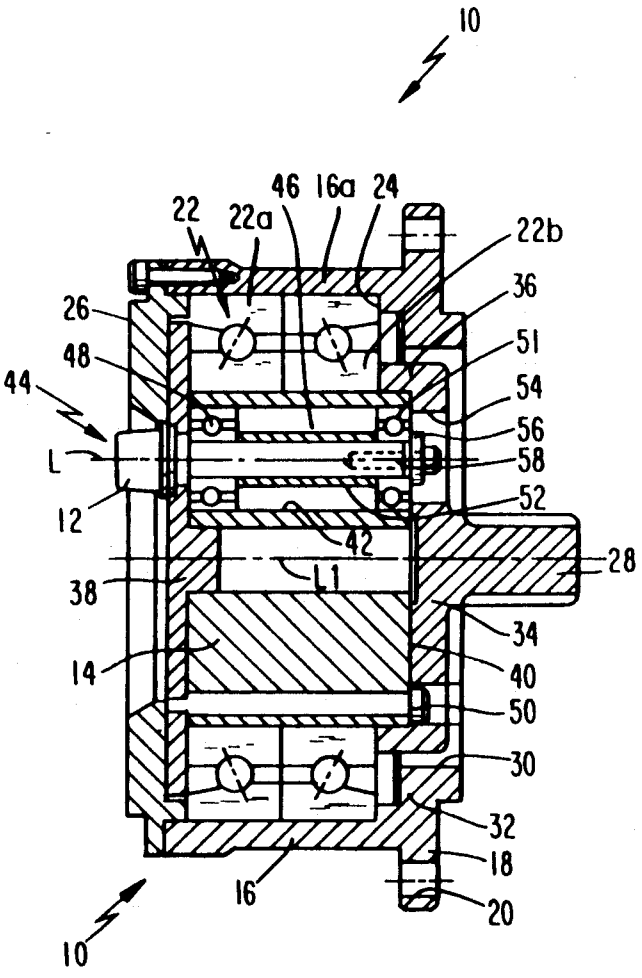
FIG. 1 is a cross-sectional side view of a flanging head assembly taken along the line 1—1 of FIG. 2.
Figure 3:
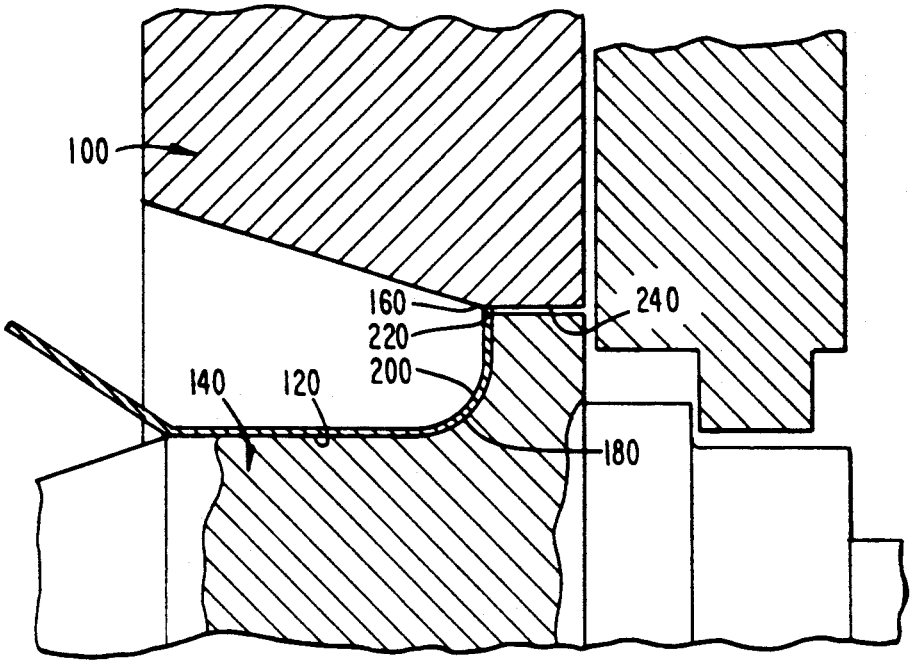
FIG. 3 PRIOR ART
FIG. 3 is an enlarged cross-sectional view of the interface typically formed between each of the spin flanging rollers with the surrounding stop ring in accordance with the prior art.

FIG. 1 is an illustration of one of flanging heads 10 of the invention which are circumferentially spaced around the periphery of the flanging turret (not shown). Each flanging head 10 comprises a plurality (e.g., five) of circumferentially spaced reforming spinners (spin flanging rollers) 12 each supported, in a freely rotatable manner about its longitudinal axis L, in a central housing or cage 14 rotatable about a central longitudinal axis L1 around which the spinners are rotated in planetary relationship during flanging. More specifically, flanging head 10 includes a cylindrical outer housing 16 formed with a mounting flange 18 adapted to be bolted as at 20 to a mounting disk (not shown) attached to the flanging turret as is well known. The central housing 14 is rotatably disposed in outer housing 16 by means of ball bearings 22. The outer race **22*a* of bearings 22 is axially fixed within housing 16 by rear contact with a shoulder 24 projecting radially inward from the cylindrical side wall 16*a* and forward contact with a stop ring 26 described in more detail below. A splined shaft 28 projecting rearwardly from an opening 30 formed in the bottom wall 32 of the cylindrical outer housing 16 is formed with an enlarged portion (driven member) 34 having a peripheral upstanding wall 36 radially inwardly spaced from and coplanar with the shoulder 24 to engage the rear surface of the inner race 22*b*. A retainer plate 38 sandwiched between the front end of the inner race 22*b* and the stop ring 26 prevents forward axial movement of the inner race. This retainer 38 also engages the front end surface of the central housing 14 to retain same in the outer housing 16 while the enlarged portion 34 of the splined shaft 28 engages the rear surface 40 of the central housing to assist in preventing rearward axial movement thereof. Bolts 50 extend through the enlarged portion 34, central housing 14 and the retainer plate 38 to secure these parts together within the outer housing 16**.

The central housing 14 is further formed with circumferentially spaced axial through-bores 42 each adapted to receive a reforming spinner assembly 44 therein. The individual spinner assemblies 44 are each formed with an elongate mounting shaft 46 projecting rearwardly into the through-bore 42 for rotational mounting therein via front and rear ball bearings 48 and 51 disposed at opposite ends of the through-bore. The bearings 48,51 are spaced from each other with a spacer 52. The through-bores 42 are in axial alignment with apertures 54 formed in the enlarged portion 34 of the shaft 28. These apertures 54 receive a clamp washer 56 and bolt 58 secured to the rear face of the spinner mounting shaft 46 to retain the shaft and thereby the flanging roller 12, projecting forwardly from the shaft, for rotation in the through-bore 42 about its axis L.

Figure 2:
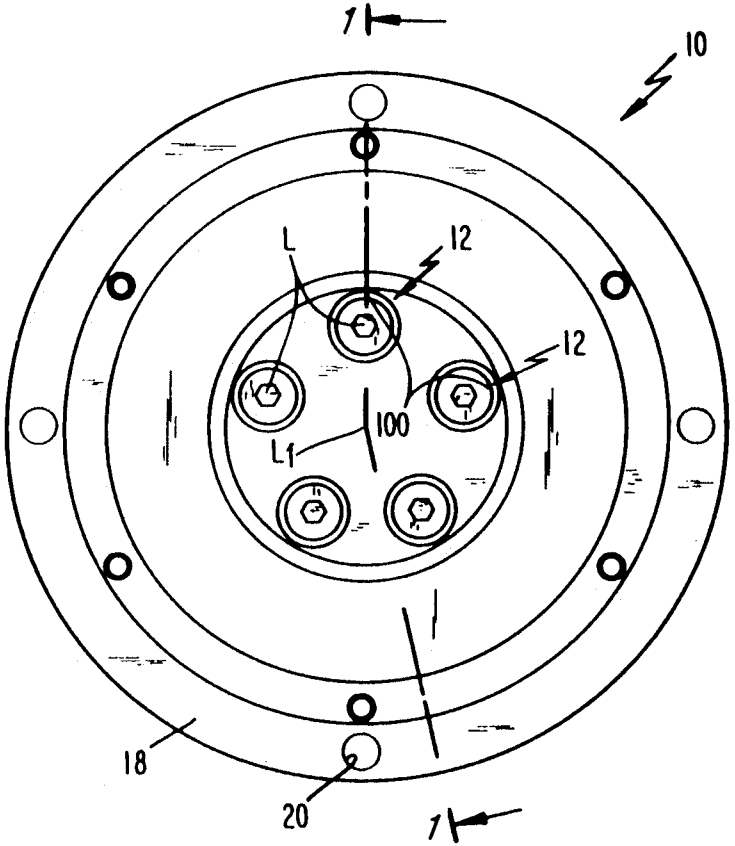
FIG. 2 is a front end view of the head assembly of FIG. 1.

Known gearing means (not shown) is provided within the flanging turret in meshing contact with the center splined shaft 28 to rotate the inner assembly 34,14,38 and thereby the individual spinner assemblies 44 about central axis L1 (FIG. 2).

As the inner assembly rotates, the marginal necked portion 60 (FIG. 4) of the can 62 is cammed into contact with the rotating cluster of rotating spinners 12 which are depicted in FIG. 2. Since the can does not rotate, contact between the marginal end 64 with the rotating spinners 12 induces free rotation of each spinner which results in flange formation as the open end of the can 62 contacts the progressively larger diameter forming surface portions 66 of the rotating spinner. These progressively larger diameter portions 66 cause corresponding enlargement of the can end and deflection of the metal into a flange 68 extending approximately perpendicular to the longitudinal axis of the can 62.

Figure 4:
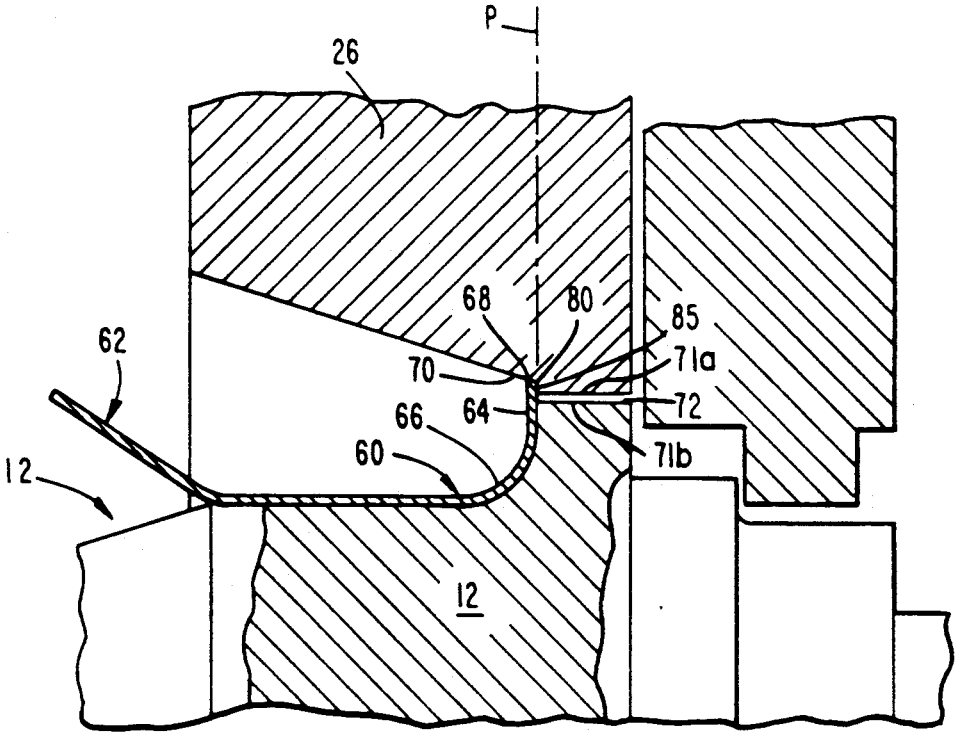
FIG. 4 is an enlarged cross-sectional view, similar to FIG. 3, but depicting an improvement in accordance with a first embodiment of the present invention.

As the formed flange 68 is in its final forming stages during final camming movement of the can 62 against the rotating spinners 12, the flange end contacts the stop surface 70 of the stationary stop ring 26 as depicted in FIG. 4, whose purpose is to stop the flange 68 at a specific preselected diameter so that the flange has the same width along all sides of the can 62. In practice, however, as previously described, the annular flange 68 usually strikes one side of the stationary stop ring surface 70 before it hits all sides thereof, as previously mentioned. When this happens, it usually takes only a small additional force to disadvantageously force the flange into the crack 240, possibly causing an undesirable sequence of events, culminating in a ruined can.

The stop ring 26 is advantageously formed with a step 80 defining a shoulder or ledge adapted to space the stop surface 70 from the lower radially inwardly spaced surface 71*a* extending coextensive with a corresponding surface 71*b* of the spinner which defines the crack (or interface gap) 72 therebetween. During the final stages of flange forming, as the edge of the flange 68 slides around the flange roller forming surfaces 66, it will pass over the crack 72 and slide across the shoulder 80 to lodge in the corner 85 of the stop ring 26, i.e., defined by the intersection between the shoulder 80 and stop surface 70 which are preferably perpendicular to each other in sectional view. Once the terminal end of the flange 68 is locked into the corner 85 of the stop ring 26, it cannot back up, and it becomes entrapped in the crack 72.

The step 80 is preferably as shallow as possible but must be deep enough to trap the flange 68. Based upon experimentation, a step 80 having a radial depth of about 0.010–0.040 inches is preferred.

Figure 5:
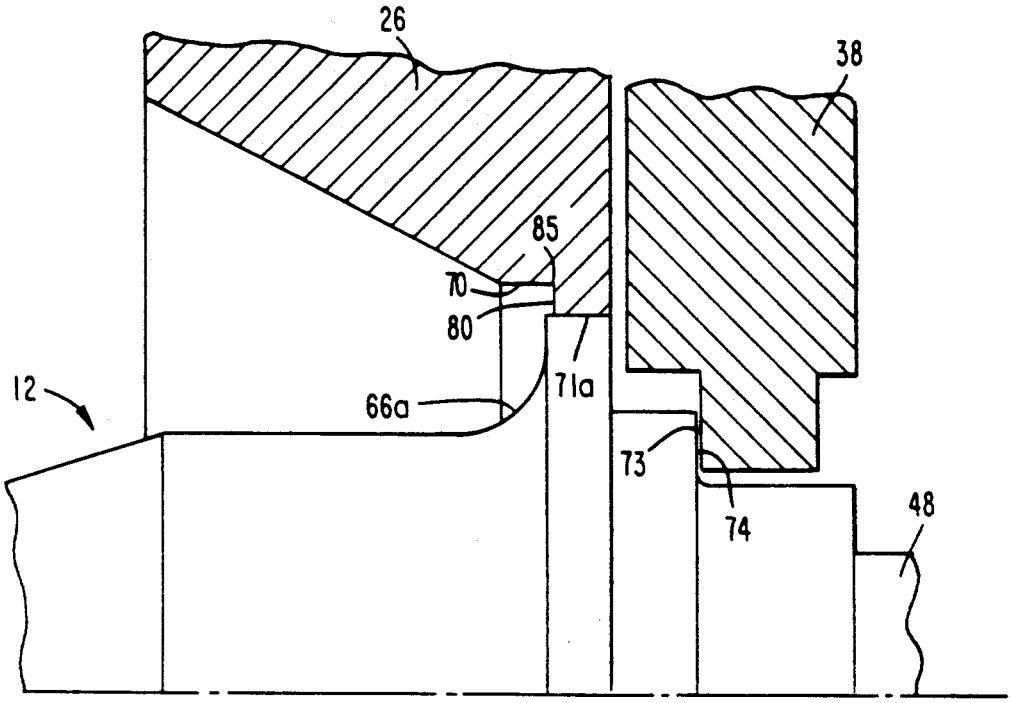
FIG. 5 is an enlarged cross-sectional view, similar to FIG. 4, of a second embodiment of the present invention.

FIG. 5 is an illustration of a second embodiment of the invention wherein each forming roller 12 includes a flange forming surface 66*a* having an outermost end spaced axially forwardly from the step 80 in the direction of the can bottom to prevent the terminal end 68*a* of the flange 68 (FIG. 4) from inadvertently abutting against the stop ring surface 71*a* (FIG. 4) defining part of the crack 72 (FIG. 4).

In the flanging assembly of this invention, flanging occurs by advancing the open end of the can 62 in a known manner into flanging contact with the rotating spinners 12 under a predetermined load which is typically 60–75 pounds. Since the marginal edge 64 of the can 62 being flanged only contacts those peripheral portions 100 (see FIG. 2) of the five rotating spinners 12 which are located adjacent the stop ring 26, the axial loading applied to the can is supported by only those five peripheral contact portions 100 between the marginal edge and rotating spinners. As a result of extensive experimentation, it has been discovered that, in the unsupported circumferential regions of the flange between these rotating spinner supporting portions 100, the flange sags forwardly (i.e., in the direction of the open can end) by approximately 0.020–0.030 inches. Thus, the portion of the flange in between the spinners is unsupported. It relaxes elastically into the shape of a pentagon with rounded corners, as depicted in FIG. 7A, which allows the outside edge 112 of the flange 68 to move radially (into the phantom position 112') toward the center of the can and slide off of step 80. The tip of the flange 68 now sags forwardly toward the open end of the can (FIG. 7B) and is opposite surface 71*a* in the FIG. 4 embodiment as best shown in FIG. 7C. As the rollers 12 progressively rotate into flanging contact with the entire periphery of the marginal edge 64, the rollers must "scoop" up the sagging portions 112' of the flange back toward the vertical plane P defined by the outermost portion of the flange roller forming surface 66 and the step 80 in FIG. 4. In actuality, however, the rotating spinner attempts to scoop the flange 68 back up onto step 80, but the tip 68 tends to hit surface 71*a* first and is rolled into the crack 72 formed by surfaces 71*a* and 71*b*. This rolling action forms an extruded angular flange or ear on the edge of the flange 64, thus making the can defective.

Figure 6:
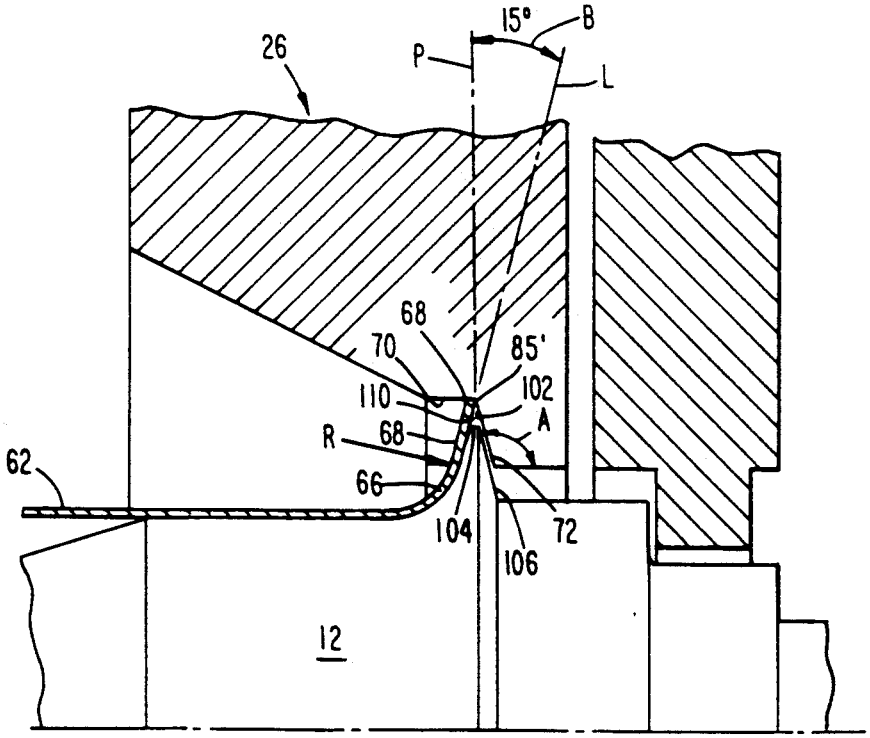
FIG. 6 is an enlarged cross-sectional view of a preferred embodiment of the present invention.

To avoid this problem, in the preferred embodiment of the invention depicted in FIG. 6, the step 80 is formed as an inclined surface 102 (e.g., a conical section) extending radially inwardly from a point of intersection 85' with stop surface 70, at a predetermined angle A, in the direction of the open end of the can (i.e., in the direction away from the can bottom). An important benefit of the preferred embodiment is that the sagging portions 112' of the unsupported flange is now supported by surface 102 in between the spinners when it sags forwardly. Since surface 102 provides positive support for the sagging portions 112', it prevents the flange from sagging further forward. Advantageously, therefore, the spinners do not have to lift the flange as far to return it into contact with corner 85'. The presence of surface 102 extending radially inwardly a sufficient extent to contact the sagging flange portion 112' also serves to prevent bending the edge of the flange 68 back toward the closed end of the can which would disadvantageously tend to produce a flange which is grossly curved toward the closed end.

Figure 8:
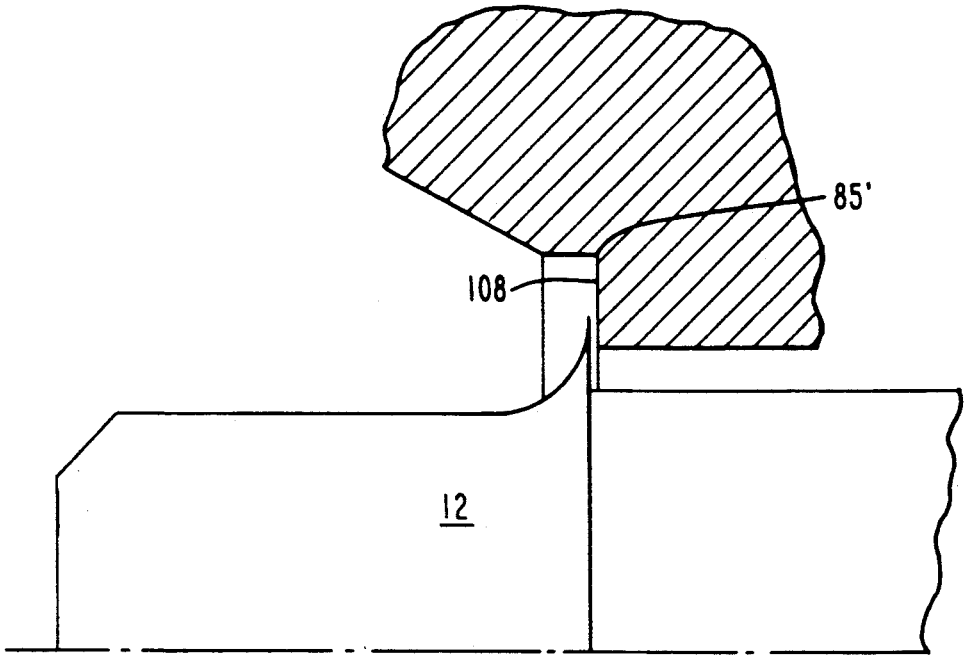
FIGS. 8 and 9 are variations of the preferred embodiment of FIG. 6.
Figure 9:
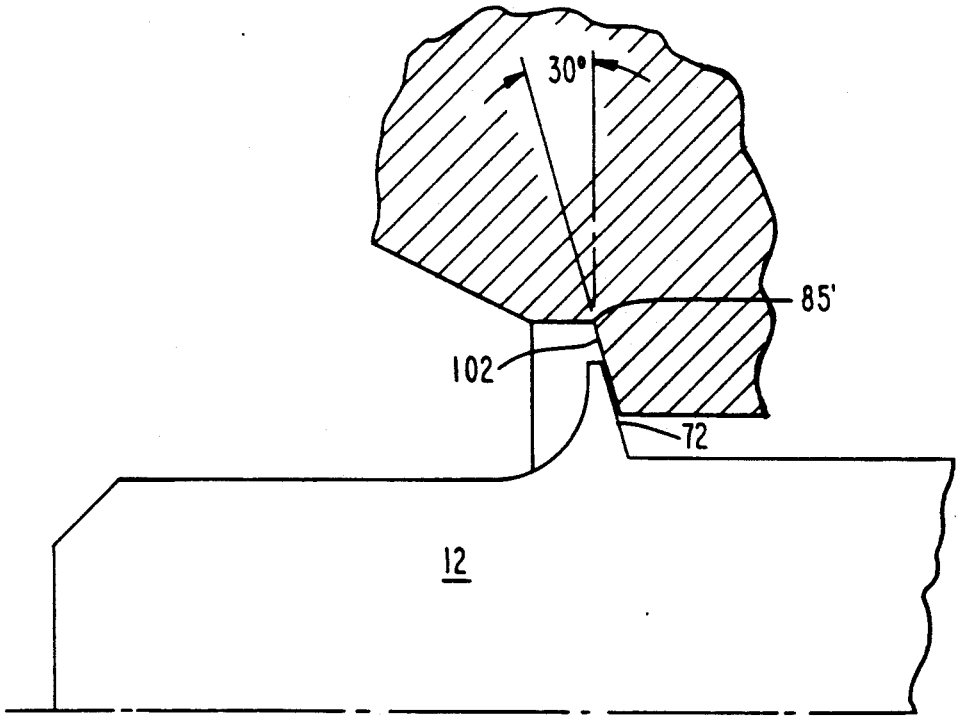
Figure 2:
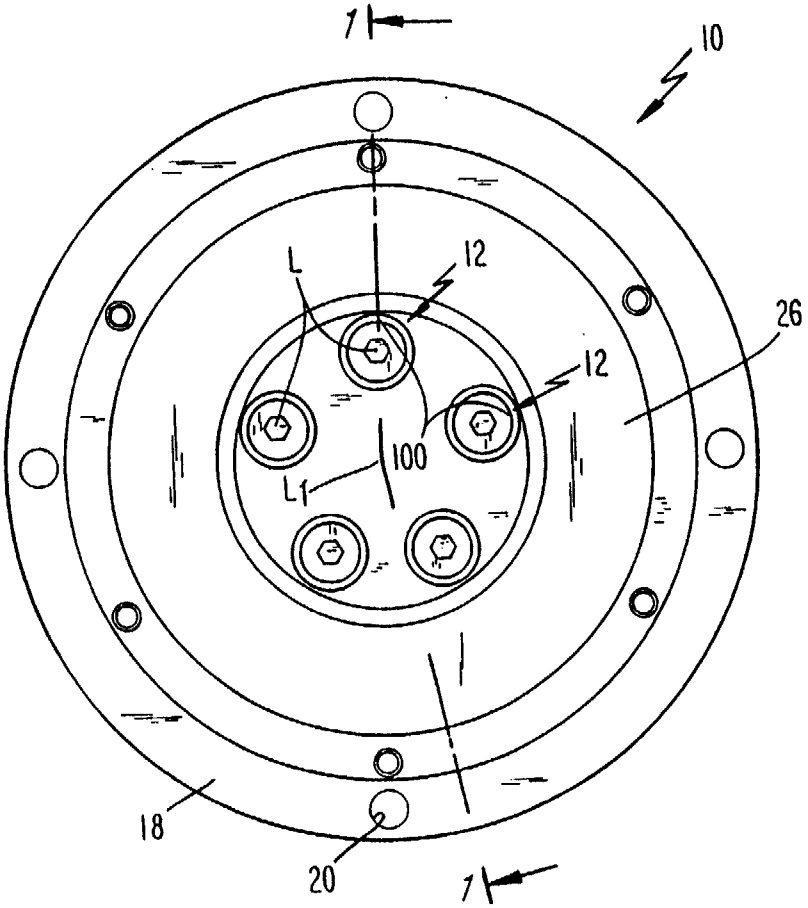
Figure 1:
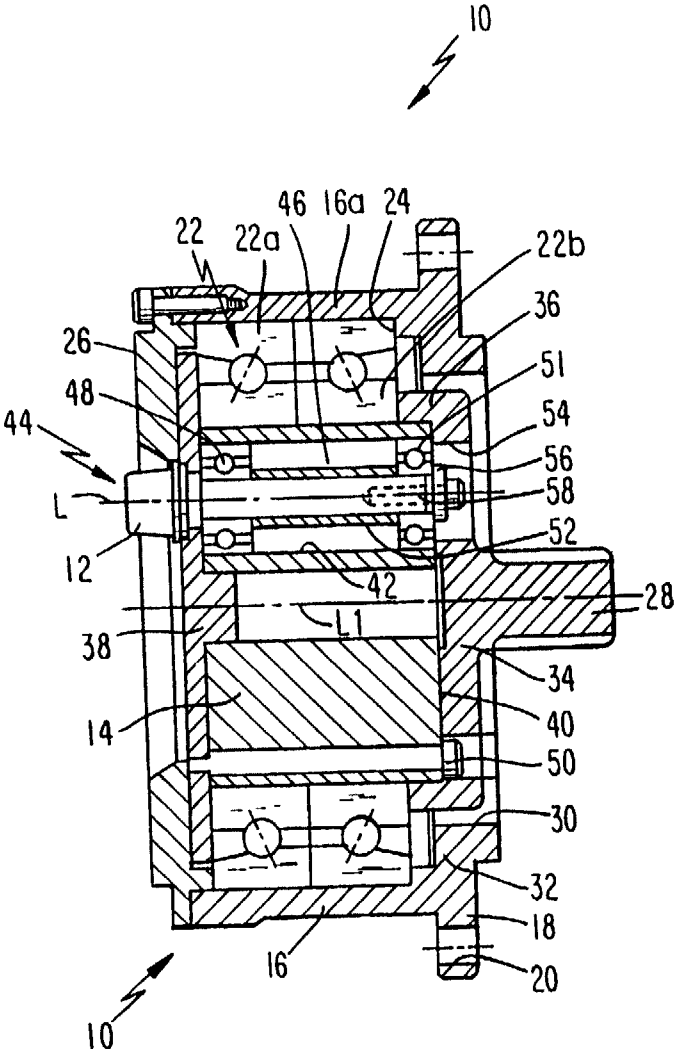
Figure 7B:
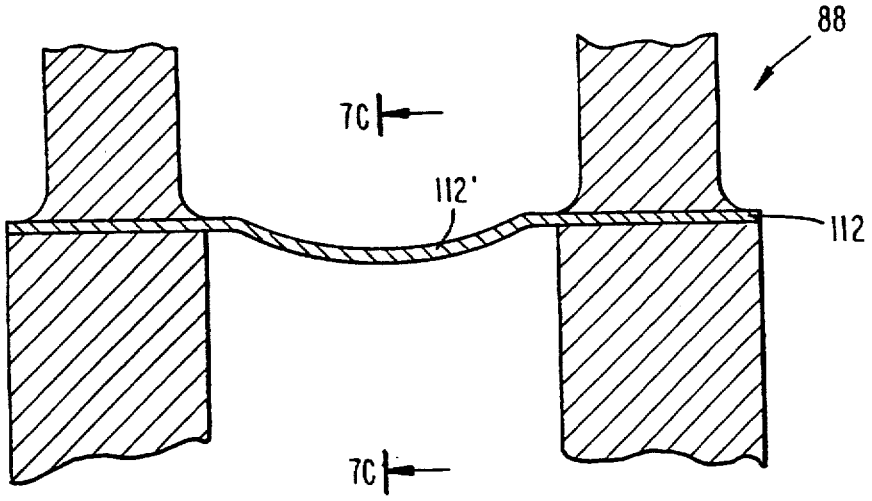
Figure 7A:
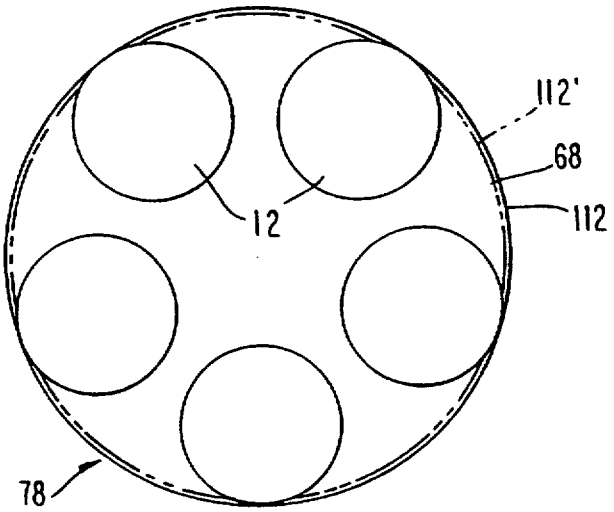
Figure 7C:
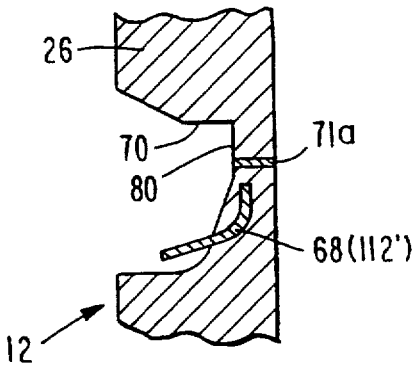

In the preferred embodiment, the angle of surface 102 is preferably 30° (i.e., angle A = 120°) but can vary. For example, with reference to FIG. 8, the theoretical optimum angle is 0°. However, the spinner 12 would then have a thin knife or feather edge which is not practical from an engineering standpoint. As depicted in FIG. 9, the practical limit of the angle of surface 102 is from about 10° to 40°. The most practical angle that provides for a strong enough edge on the spinner while minimizing the distance the spinner must lift the flange from surface 102 back into corner 85' is about 20°–30°.

By controlling the sagging of portions 112' in the manner set forth above, the unsupported flange portions being lifted back onto the forming surfaces tend not to get caught in the crack 72 formed between the spinners and stop ring. It will now be understood by one of ordinary skill in the art that the FIG. 4 or 5 embodiments of this invention may be modified to support the sagging portions 112' of the flange by appropriately radially inwardly extending step 80 towards the spinner axis so that the flange contacts the step between adjacent spinners.

Referring back to the FIG. 6 preferred embodiment of this invention, the inclined surface 102 locates the crack 72 in an axially forwardly spaced relationship with the flange by means of an axially extending surface 104 of the rotating spinner 12. This surface 104 spaces the outermost peripheral point of the flange forming surface 66 from the crack 72 and defines, in combination with both the step or inclined surface 102, a space 110 which may be of triangular cross-section as depicted in FIG. 6. It is theorized that by recessing the crack 72 away from the flange 68 by means of surfaces 102,104, the sagging portions of the flange between adjacent ones of the rotating spinners 12 cannot get lodged within crack 72 because the crack is spaced from the flange by the surface 104 and is scooped back up by the forming surface 66 (as the unsupported flange portion approaches the forming surface).

Although this space 110 may have the beneficial effects noted hereinabove, it is not believed critical to successful operation of the invention. What is important is that the surface 102 project radially inwardly a sufficient distance from corner 85' so as to provide controlled support for the sagging flange portion 112' in the manner set forth above.

As depicted in FIG. 6, the flange forming surface 66 has a predetermined radius of curvature R intersected at the radially outwardmost point of the flange forming surface 66 by a tangent line L. In accordance with another feature of the preferred embodiment, this tangent line L extends forwardly at a predetermined angle B in relation to a reference line P' which is representative of a horizontal plane when the can is positioned in an upright manner, or a vertical plane (perpendicular to the can longitudinal axis) in the flanging position depicted in FIG. 6.

As a result of further experimentation, it was discovered that flange width variation is dependent on the axial load applied to the can during the flanging operation and that the poundages required to flange are different for different thick wall thicknesses and different end sizes. For example, in the case of an aluminum can having a 204 neck (can-makers terminology) and 0.0064 inches thick wall thickness, if only 45–50 pounds is applied to the can, the flange 68 will tend to touch the stop ring stop surface 70 only on one side and the flange width will be in the range of 0.077"–0.088". If the axial load is raised to about 65 pounds, the flange 68 hits the stop ring surface 70 almost completely around its entire periphery and the flange width is from 0.085" to about 0.090" and a "flat" flange is formed. The term "flat" means that the flange 68 extends along plane P'. If the axial load is raised to about 75 pounds, the flange is pushed hard against the stop ring surface 70 around its entire periphery for 360° and the flange width is 0.088" to about 0.090". In this latter case, however, the flange angle is slightly negative, i.e., the flange 68 projects downwardly relative to the open end of the can.

It is desirable to have a fairly flat flange (i.e., extending in the plane P as depicted in FIG. 6) or a flange angle which is slightly negative since the slight negative angle could be a benefit in seaming in that it might eliminate the digging in of the flange into the compound material of the can end. This could give more consistent body hook length for a given flange width. As a result of extensive experimentation, it has been discovered that, with the geometry of the stop ring 26 of FIG. 6 of the present invention, tangent line L preferably extends at an angle B of about 15°–20°, and preferably 15°, which will result in a substantially flat flange during the flanging operation. Although the forming dynamics embodied in this unexpected result are not clearly understood, it is theorized that the combination of a tilted angle (i.e., the outermost supported portion of the flange extending on the forming surface along tangent line L), coupled with the unsupported portions of the flange sagging into the gap 110 toward the recessed crack 72 being bent back up as the sagging portions of the flange contact the flange forming surface 66, results in the flange being finally formed as a flat flange.

In summary, the stop ring in the preferred embodiment of FIG. 6 now has a corner 85' which is preferably tangent with the flange angle on the spinner 12. This corner 85' is formed by the support flange 102 which now angles behind the spinner 12, the back surface of the spinner being angled to clear the support surface 102. The angle of this back surface can be between 10° to 40°.

The corner 85' and angled surface 102 perform three functions which are key to excellent flange width control. First, the corner 85' locks the edge of the flange since the corner preferably lies on a tangent line to the forming surface angle on the spinner. This maintains the edge of the flange at a single point. Second, the corner 85' and surface 102 also prevent the edge from being turned in and pinched between the spinner and the stop ring. Finally, the angular surface 102 supports the flange between the flanging rollers so that the roller does not have to force the flange very far to get it back up to the plane of the spinners. The base pad is applying 60 to 90 pounds of axial force on the can and the flange is being supported only by the small contact area of the outside arc of the five spinners. As the flange of the can is being forced around the radius of the spinners and the base pad force builds up to, for example, the 60 to 90 pound range, some of this force is now advantageously transferred to the stop ring support surface 102. In practice, the base pad force causes the longer side or sides of the flange to contact the corner(s) 85' before the shorter side or sides of the flange which are supported on the spinners and have not yet contacted their associated corner(s) 85', while being supported by the angular surface 102. Thereby, now most of the remaining force on the spinners is directed to the short sides of the flange which have not yet reached the support surface 102, causing the short sides to deform towards their associated corners 85'. This has been discovered to be the key to the uniformity achieved with this new type of spin flanger.

If this corner and support surface were not there, the rollers would exert excessive force on the can. The constant flexing of the flange edge, because of its deflection between the rollers, also is a source of split or cracked flanges. The support surface and corner 85' therefore offers support for the can so that sufficient axial force can be applied to the can to force the long side of the flange into the stop ring corner hard enough to bring the short portion out to the stop ring as well to achieve uniform flange width. Generally, the long side is with the grain and the short side is across the grain.

It will be readily seen by one of ordinary skill in the art that the present invention fulfills all of the objects set forth above. After reading the foregoing specification, one of ordinary skill will be able to effect various changes, substitutions of equivalents and various other aspects of the invention as broadly disclosed herein. It is therefore intended that the protection granted hereon be limited only by the definition contained in the appended claims and equivalents thereof.

We claim:

1. A flanging head assembly for forming a peripheral outwardly directed flange in a free edge portion of a can having a cylindrical body, comprising a plurality of flanging rollers having profiled flange forming surfaces adapted to receive said free edge portion and spin same in a radially outward direction during relative axial movement of said free edge portion toward and against progressively larger diameter portions of said forming surfaces; housing means for mounting said flanging rollers about a central longitudinal axis thereof; means for revolving said rollers about said central longitudinal axis to create spinning contact with said relatively axially advancing free edge portion, and a stop ring having a stop surface mounted adjacent a trailing end of said forming surfaces to contact the free edge of the flange as it moves off the forming surfaces to limit the diameter of the flange, the improvement comprising a step formed in the stop ring which spaces the stop surface from the forming surfaces to enable the terminal end of the flange being formed to travel past an interface gap between the roller and stop ring and across the step to contact the stop surface and avoid movement of a portion of the terminal end of flange into the gap.

2. The assembly of claim 1, wherein said step and trailing end of the forming surface are generally co-planar and spaced from each other by said gap.

3. The assembly of claim 2, wherein the trailing end of the forming surface of each roller is the largest diameter of the forming surface of the roller.

4. The assembly of claim 1, wherein said step and stop surface are generally perpendicular to each other.

5. The assembly of claim 1, wherein said step and stop surface form a sharp interior corner to capture and trap the flange end thereagainst.

6. The assembly of claim 5, wherein said step and stop surface are generally perpendicular to each other.

7. The assembly of claim 1, wherein said step has a radial width of about 0.010–0.040 inches.

8. The assembly of claim 1, wherein said step is formed as an annular surface.

9. The assembly of claim 1, wherein the trailing end of the forming surface is spaced from the step and slightly axially forwardly thereof in the direction of the advancing free edge portion to ensure that the flange end does not contact the surfaces between the forming surface and stop surface defining the gap.

10. The assembly of claim 1, wherein said step is a surface which is inclined with respect to the stop surface and extends forwardly from the stop surface in the direction away from the can bottom to form the interface gap with the roller, which gap is thereby spaced forwardly from the flange.

11. The assembly of claim 10, further including a spacing surface on the rotating spinner extending axially from a point of intersection with the flange forming surface forwardly to a point of intersection with said interface gap.

12. The assembly of claim 1, wherein the portions of the flange between adjacent rollers tend to relax elastically and sag forwardly and radially inward toward the center axis of the can, said step extending radially inwardly from the stop surface a sufficient distance to contact said sagging flange portions and thereby control the distance through which the flange forming surfaces of the rollers have to lift the sagging portions back onto the step towards the stop surface.

13. The assembly of claim 12, wherein the step extends radially inwardly from the corner defined between the step and stop surface so as to lie in a plane perpendicular to the can axis.

14. The assembly of claim 12, wherein the step is an inclined surface extending forwardly from the stop surface in the direction away from the can bottom at an angle of about 10°–40° relative to a plane extending through the corner perpendicular to the can axis.

* * * * *

UNITED STATES PATENT AND TRADEMARK OFFICE

CERTIFICATE OF CORRECTION

PATENT NO. :5,235,839

DATED :August 17, 1993

INVENTOR(S) :Harry W. LEE ET AL

It is certified that error appears in the above-indentified patent and that said Letters Patent is hereby corrected as shown below:

Col. 6, line 29, 4, after "step 80" insert --(Fig. 4)--;

line 36, 10, after "112'" insert --(Figs. 7A, 7B, 7C)--;

line 61, after "112'" insert --(Figs. 7A, 7B, 7C)--.

Col. 7, line 25, after "112'" insert --(Figs. 7A, 7B, 7C)--.

line 33, change "P" to --P'--.

Col. 7, line 53, change "P" to --P'--.

In the drawings:

Please substitute sheet 1 of 5 containing Figures 1 and 2 with the attached sheet containing Figure 1 and corrected Figure 2.

Please substitute sheet 4 of 5 containing Figures

UNITED STATES PATENT AND TRADEMARK OFFICE

CERTIFICATE OF CORRECTION

PATENT NO. : 5,235,839

DATED : August 17, 1993

INVENTOR(S) : Harry W. Lee, et al

Figure 7B:
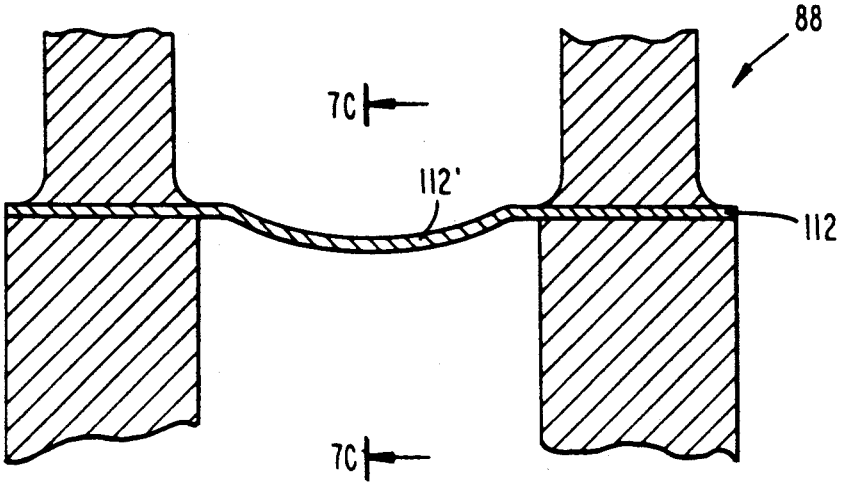
FIG. 7B is a view taken along the arrow 7B of FIG. 7A to depict a sagging flange portion.
Figure 7A:
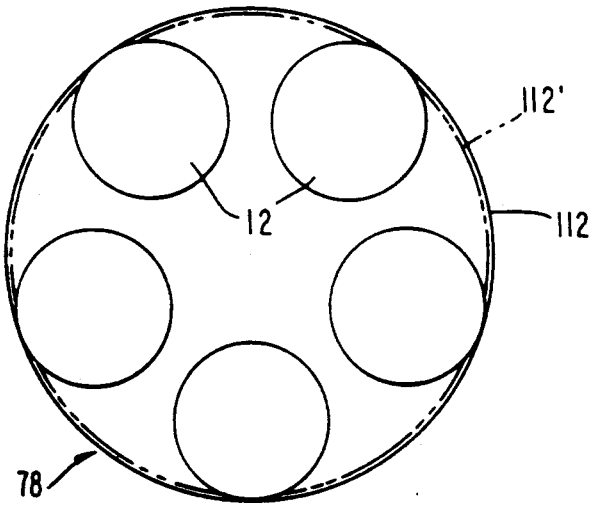
FIG. 7A is a plan view, partly schematic, depicting the flange in elastically relaxed condition as a result of axial loading during flanging.
Figure 7C:
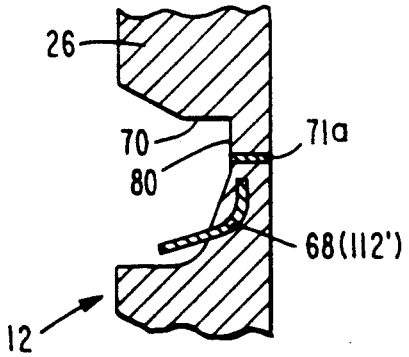
FIG. 7C is a sectional view taken along the line 7C—7C of FIG. 7B.

It is certified that error appears in the above-indentified patent and that said Letters Patent is hereby corrected as shown below:

7A, 7B and 7C with the attached sheet containing corrected Figure 7A and Figures 7B and 7C.

Signed and Sealed this

Eighth Day of November, 1994

*Attest:*

Bruce Lehman

BRUCE LEHMAN

*Attesting Officer*

*Commissioner of Patents and Trademarks*